United States Patent [19]

Kay et al.

[11] 4,098,657

[45] Jul. 4, 1978

[54] ELECTROLYTE DEHYDROHALOGENATION OF α-HALOALCOHOLS

[75] Inventors: Ian Trevor Kay, Wokingham; Alfred Glyn Williams, Basingstoke, both of England

[73] Assignee: Imperial Chemical Industries Limited, London, England

[21] Appl. No.: 745,781

[22] Filed: Nov. 29, 1976

[30] Foreign Application Priority Data

Dec. 17, 1975 [GB] United Kingdom ..... 51615/75

[51] Int. Cl.[2] ..... C25B 3/00; C07C 17/00; C07C 21/06; C07C 29/00

[52] U.S. Cl. ..... 204/59 R; 204/72; 568/845; 260/654 D

[58] Field of Search ..... 260/633, 654 D; 204/59 R, 72, 73 R

[56] References Cited

U.S. PATENT DOCUMENTS

| | | | |
|---|---|---|---|
| 1,901,316 | 3/1933 | Meerwein | 260/633 |
| 2,552,980 | 5/1951 | Ladd et al. | 260/633 UX |
| 3,324,187 | 6/1967 | Litt et al. | 260/633 |
| 4,018,838 | 4/1977 | Cleare | 260/654 R |

FOREIGN PATENT DOCUMENTS

| | | | |
|---|---|---|---|
| 11,041 | 6/1967 | Japan | 260/654 R |
| 1,145,372 | 3/1969 | United Kingdom | 204/72 |

OTHER PUBLICATIONS

Abstract 762,873 by Ehrenfeld, Pub. 5/22/51.

Handbook of Chemistry & Physics, 52nd Ed., 1971, p. D-121, Pub. by Chemical Rubber Co.

*Primary Examiner*—F.C. Edmundson

*Attorney, Agent, or Firm*—Cushman, Darby & Cushman

[57] ABSTRACT

Reductive dehydrohalogenation of an α-haloalcohol to form an alkene by subjecting the haloalcohol to electrolysis in the presence of a liquid diluent and a strong mineral acid. The electrolysis may be carried out in a diaphragm cell using a high hydrogen over voltage cathode.

11 Claims, No Drawings

ELECTROLYTE DEHYDROHALOGENATION OF α-HALOALCOHOLS

This invention relates to reductive dehydrohalogenation of α-haloalcohols by an electrochemical process to give alkenes, and more particularly it relates to the reductive dehydrochlorination of chloral adducts with alkenes.

Farkas et al. (Collection Czechoslov. Chem. Commun., (1959), 24 2230-2236) describes the preparation of 1,1-dichloro-4-methyl-1,3-pentadiene. This compound is useful as an intermediate in the preparation of insecticidal esters (for example, the allylrethrolonyl ester) of 2(2,2-dichlorovinyl)-3,3-dimethylcyclopropane carboxylic acid which can be obtained by the reaction of the above pentadiene with ethyl diazoacetate followed by hydrolysis of the ethyl ester. The procedure for preparation of the pentadiene described by Farkas et al. involves condensation of chloral with isobutylene according to the method of Colonge et al. (Bull. soc. chim. France, (1957) 204) to yield a mixture of 1,1,1-trichloro-2-hydroxy-4-methyl-3-pentene and 1,1,1-trichloro-2-hydroxy-4-pentene, followed by preparation of the mixed acetates thereof. Treatment of the mixed acetates with about 4 equivalents of zinc dust in a mixture of diethyl ether and acetic acid yields a mixture of 1,1-dichloro-4-methyl-1,3-pentadiene and 1,1-dichloro-4-methyl-1,4-pentadiene which on heating with a small amount of p-toluenesulphonic acid yields substantially pure 1,1-dichloro-4-methyl-1,3-pentadiene.

This procedure is not well suited to large scale preparation of the required diene because it involves a large number of separate steps, it uses a relatively large quantity of zinc dust which can give rise to problems of effluent disposal, and uses ether in conjunction with the zinc powder at one stage which makes that particular step potentially very hazardous because of the high flammability and low flash point of ether and the pyrophoric nature of finely powdered zinc dust.

We have now discovered that the reductive dehydrohalogenation procedure can be carried out very simply by an electrochemical process, and that this process is safer than the process using zinc reduction, and that it may be readily adapted for large scale use as it produces no problem effluents. Furthermore the improved procedure may equally well be used for the preparation of other 1,1-dihalo-4-methyl-1,3-pentadienes and 1,1-dihalo-4-methyl-1,4-pentadienes.

According to the present invention an imporved process for the preparation of a compound of formula:

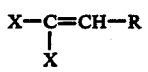

wherein X is halogeno and R is either a group of formula:

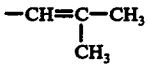

or a group of formula:

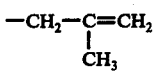

comprises subjecting a haloalcohol of formula:

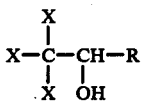

to electrolysis in the presence of a liquid diluent.

The liquid diluent may be chosen from organic solvents, for example, alkanols containing up to 4 carbon atoms, such as methanol or ethanol, cyclic ethers such as dioxan or tetrahydrofuran, aliphatic ketones such as acetone or cyclohexanone, or mixtures of these solvents with water or water containing strong mineral acids such as sulphuric, hydrochloric or phosphoric acids.

The reduction is believed to occur principally at the cathode with a high hydrogen overvoltage, for example a mercury, lead amalgam or lead cathode. The reaction can be conveniently carried out in a cell fitted with a porous diaphragm, e.g. a ceramic or glass fitted diaphragm, a stirrer, a working electrode and a reference electrode, for example a standard calomel electrode. The purpose of the diaphragm is to define anode and cathode compartments in the cell. A suitable cell is illustrated in Chemical Technology, 4 (3), p. 185. The process is preferably conducted in the potential range −1100 to +1700 mV (SCE), and using a current density of 5 to 10 mA/cm$^2$. The process may be adapted for continuous production of the required product by use of a solvent system with which the product of the reaction may be extracted, for example methylene chloride.

The use of the electrochemical reduction procedure of the present inventin eliminates the costly problems of effluent control and metal recovery associated with reduction by zinc.

The improved process of the invention also represents an advance over the known process in that the haloalcohol itself may be directly reduced without the necessity of first converting it to the acetate.

Now the improved process is, as stated above, applicable to the preparation of 1,1-dihalo-4-methyl-1,3-pentadienes and 1,1-dihalo-4-methyl-1,4-pentadienes. These materials may be useful as monomeric intermediates in the preparation of copolymers with other ethylenically unsaturated monomers, for example, vinyl chloride, vinyl acetate, acrylonitrile, methyl methacrylate, and the like. They may also be useful in the preparation of resins, for example, alkyd resins. By the term "halo" or "halogeno" as used herein we mean fluoro, chloro, bromo and iodo.

The 1,1-dihalo-4-methyl-1,3-pentadienes are also useful in the synthesis of certain insecticidal cyclopropane derivatives. 1,1-Dichloro-4-methyl-1,3-pentadiene and 1,1-dibromo-4-methyl-1,3-pentadiene are particularly useful for this purpose, and can be reacted with alkyl diazoacetates to provide the alkyl esters of 2(2,2-dichlorovinyl)-3,3-dimethylcyclopropane carboxylic acid, and 2(2,2-dibromovinyl)-3,3-dimethylcyclopropane carboxylic acid respectively. Certain esters of these acids, for example, the 3-phenoxybenzyl, and α-cyano-3-phenoxybenzyl esters, are extremely potent insecticides.

Although it is the 1,1-dihalo-4-methyl-1,3-dienes which are directly useful in the synthesis of these insecticidal cyclopropane derivatives, these conjugated dienes may be obtained from the corresponding unconjugated 1,4-dienes, for example by heating with an organic acid, for example p-toluene sulphonic acid.

In a preferred form the invention provides a process for the preparation of a compound of formula:

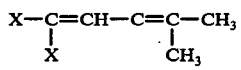

wherein X is chloro or bromo, which comprises (a) the step of subjecting a haloalcohol of formula:

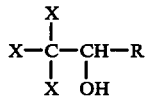

wherein R represents either the group of formula:

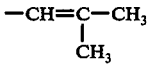

or the group of formula:

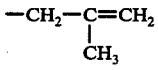

to electrolysis in the presence of an inorganic acid; and (b) the additional step of subsequently heating the reaction mixture at a temperature within the range 80° to 120° C with a catalytic quantity of an organic acid (other than acetic acid), to cause isomerisation of any of the unconjugated 1,4-diene formed in the first stage to the conjugated 1,3-diene. It is particularly convenient to raise the temperature of the reaction mixture for this adddition step to the reflux point. p-Toluene sulphonic acid is a preferred organic acid.

The haloalcohols of formula:

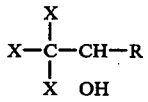

wherein X and R are as defined hereinabove, may be obtained by a procedure analogous to that of Colonge et al. (loc. cit.), from trihaloacetaldehyde and isobutylene in the presence of a Friedel-Crafts catalyst, for example aluminium chloride. Thus the reaction of anhydrous chloral with isobutylene in this way yields a mixture of 1,1,1-trichloro-2-hydroxy-4-methyl-3-pentene and 1,1,1-trichloro-2-hydroxy-4-methyl-4-pentene. Similarly when anhydrous bromal is reacted with isobutylene a mixture of 1,1,1-tribromo-2-hydroxy-4-methyl-3-pentene and 1,1,1-tribromo-2-hydroxy-4-methyl-4-pentene is formed. There mixtures of isomeric haloalcohols may be used directly in the improved process of the invention or they may be subjected to distillation in order to separate the constituent isomers which may then be used individually in the process of the invention.

The invention is illustrated by the following examples.

EXAMPLE 1

This example illustrates the condensation of chloral and isobutylene.

A mixture of anhydrous chloral (783 g), isobutylene (309 g), and petroleum ether (boiling range 40° to 60° C, 800 ml) was stirred at a temperature in the range −5° to −8° C whilst aluminium chloride (54.5 g) was added in small portions over a period of two hours. The mixture was stirred for a further period of 1 hour at 0° C. Water (450 ml) was then added over 15 minutes, the temperature being maintained at 0° C, after whch the mixture was allowed to attain to the ambient temperature. The organic phase was separated, washed with brine (33 × 250 ml) and dried over anhydrous magnesium sulphate. After removal of the solvent by evaporation under reduced pressure the residual oil was distilled under reduced pressure and the fraction boiling range 101° to 111° C at 16 to 18 mm Hg pressure collected. This was shown by gas liquid chromatographic examination to consist of approximately 90% 1,1,1-trichloro-2-hydroxy-4-methyl-4-pentene and approximately 10% 1,1,1-trichloro-2-hydroxy-4-methyl-3-pentene. Careful distillation afforded almos pure (by g.l.c.) 1,1,1-trichloro-2-hydroxy-4-methyl-4-penetene as a colourless oil (boiling point 99°–100° C/16 mm Hg).

EXAMPLE 2

A mixture of 2-hydroxy-4methyl-1,1,1-trichloro-4-pentene (20.4 g), concentrated sulphuric acid (98% w/v, 9.8 g) and methol (220 ml) is charged into an electrolytic cell, which is surrounded by a cooling bath set to maintain the temperature at about 15° C, and fitted with a cylindrical diaphragm, stirrer, reference electrode (SCE) and a working electrode. The cathode is a lead plate (surface area about 40 $cm^2$). Using a current density in the range 5 to 10 $mA/cm^2$ the reaction is conducted in the potential range −1100 to 1700 mV (SCE). When reduction is complete the cathodic electrolyte is neutralised with caustic soda and extracted with methylene chloride, the extracts dried over anhydrous sodium sulphate and evaporated to yield a residue of substantially pure 1,1-dichloro-4-methyl-1,4-pentadiene, which is purified by distillation.

EXAMPLE 3

A mixture of 2-hydroxy-4-methyl-1,1,1,-trichloro-4-pentene (0.5 g), methanol (10 ml) and concentrated sulphuric acid (98% w/v, 0.5 ml), was subjected to electrolysis in apparatus similar to that described in Example 1, using a lead plate cathode (surface area ca 1 $cm^2$) at a potential of 1.0 volts with reference to the standard calomel electrode, for a period of 3 hours.

After extraction and purification as described in Example 1 the product was shown by gas-liquid chromatographic analysis to be a mixture consisting of a major proportion (ca 80% v/v) of 1,1-dichloro-4-methyl-1,4-pentadiene, together with a minor proportion of the isomeric 1,1-dichloro-4-methyl-1,3-pentadiene.

EXAMPLE 4

In a further experiment using the conditions and quantities of Example 3 except that 2.0 g of 2-hydroxy-4-methyl-1,1,1-trichloro-4-penetene was used glc analysis of the product mixture revealed that some of the starting material remained unchanged after 3 hours.

EXAMPLE 5

In another experiment repeating the procedure of Example 3, but using a mercury pool cathode in place of the lead plate the reaction product was again shown to consist principally of 1,1-dichloro-4-methyl-1,4-pentadiene together with a small proportion (ca 15%) of the isomeric 1,1-dichloro-4-methyl-1,3-pentadiene.

EXAMPLE 6

The procedure of Example 5 was repeated, but electrolysis was continued for 5 hours, during which time 2 g of 2-hydroxy-4-methyl-1,1,1-trichloro-4-pentene was completely converted to a mixture of 1,1-dichloro-4-methyl-1,4-pentadiene and 1,1-dichloro-4-methyl-1,3-pentadiene.

We claim:

1. A process for the preparation of a compound of formula:

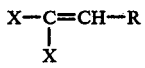

wherein X is chloro or bromo and R is either a group of formula:

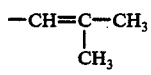

or a group of formula:

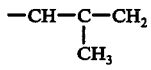

which comprises subjecting a haloalcohol of formula:

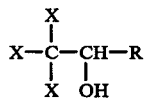

to electrolysis at a high hydrogen overvoltage cathode in the presence of a liquid diluent and a strong mineral acid selected from the group consisting of sulphuric acid, hydrochloric acid and phosphoric acid.

2. The process of claim 1 wherein the diluent comprises a solvent chosen from the group consisting of alkanols containing up to 4 carbon atoms, cyclic ethers, aliphatic ketones, mixtures of these with water.

3. The process of claim 2 wherein the electrolysis is carried out in a diaphragm cell using a high hydrogen over voltage cathode selected from the group consisting of mercury, lead amalgam and lead, a potential range $-1100$ to $+1700$ mV and a current density of 5 to 10 mA/cm$^2$.

4. A process as claimed in claim 1 wherein the diluent comprises an alkanol containing up to 4 carbon atoms.

5. A process as claimed in claim 1 carried out in a cell fitted with a porous diaphragm defining anode and cathode compartments.

6. A process as claimed in claim 1 conducted in the potential range $-1100$ to $+1700$ mV with respect to the standard calomel electrode.

7. A process as claimed in claim 1 in which a current density in the range 5 to 10 mA/cm$^2$ is used.

8. A process for the preparation of a compound of formula:

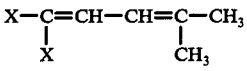

where X is chloro or bromo, which comprises (a) the step of subjecting a haloalcohol of formula:

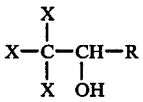

wherein R represents either the group of formula:

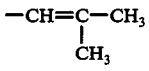

or the group of formula:

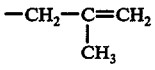

to electrolysis at a high hydrogen overvoltage cathode in the presence of liquid diluent comprising an alkanol containing up to 4 carbon atoms, and a strong mineral acid selected from the group consisting of sulphuric acid, hydrochloric acid and phosphoric acid, and (b) the additional step of subsequently heating the reaction mixture at a temperature within the range 80° to 120° C with a catalystic quantity of an organic acid other than acetic acid.

9. A process as claimed in claim 8 wherein the reaction mixture is heated at the reflux temperature in the presence of p-toluenesulphonic acid.

10. A process as claimed in claim 8 in which the haloalcohol is the product obtained by the reaction of a trihaloacetaldehyde and isobutylene in the presence of a Friedel-Crafts catalyst.

11. A process as claimed in claim 8 in which the haloalcohol is the product obtained by the reaction of anhydrous chloral or bromal and isobutylene in the presence of aluminum chloride.

* * * * *